US007192339B1

(12) United States Patent
Harding

(10) Patent No.: US 7,192,339 B1
(45) Date of Patent: Mar. 20, 2007

(54) GRINDER DISC, INSERT HOLDER AND INSERT ASSEMBLY

(75) Inventor: William R. Harding, Middletown, MD (US)

(73) Assignee: Equipment Development Company, Inc., Frederick, MD (US)

( * ) Notice: Subject to any disclaimer, the term of this patent is extended or adjusted under 35 U.S.C. 154(b) by 0 days.

(21) Appl. No.: 11/334,488

(22) Filed: Jan. 19, 2006

(51) Int. Cl.
*B24B 3/00* (2006.01)

(52) U.S. Cl. ..... 451/487; 451/465; 451/350

(58) Field of Classification Search ..... 451/350–354, 451/356–360, 487, 542, 543, 548, 463–486
See application file for complete search history.

(56) References Cited

U.S. PATENT DOCUMENTS 3,631,635 A * 1/1972 Vezner ..... 451/353
5,054,245 A * 10/1991 Coty ..... 451/353
5,567,503 A * 10/1996 Sexton et al. ..... 428/143

* cited by examiner

*Primary Examiner*—Dung Van Nguyen
(74) *Attorney, Agent, or Firm*—Michael W. York

(57) ABSTRACT

A grinder disc, insert holder and insert assembly including a grinder disc with a plurality of grinder insert holders for grinder inserts for grinding and the like. The assembly includes a grinder insert holder having a holder case with a hollow interior an open end portion and a closed end portion with and an end wall, and a resilient pad sized and shaped to be located in the hollow interior of the case adjacent to the end wall. The assembly includes a grinder insert. The insert is sized and shaped to permit it to slide into the holder case. A plurality of grinder insert holders are attached in a symmetric pattern to the outer edge portion of the disc with the open end portions facing in the direction of rotation of the disc.

8 Claims, 2 Drawing Sheets

GRINDER DISC, INSERT HOLDER AND INSERT ASSEMBLY

BACKGROUND OF THE INVENTION

Floor grinders have many uses such as leveling or smoothing concrete surfaces, repairing damaged concrete slabs, eliminating undesired buildups on floors and the like such as rubber and grease and floor grinders have been in use for many years. Basically, such floor grinders have one or more rotating discs that are driven by a motor and the disc or discs and the motor are mounted on a wheeled cart that can be moved about by an operator through the use of an upward extending handle or the like. When two or four rotating discs are present, the paired rotating discs rotate in opposite directions to reduce vibrations and provide the operator with better control.

The rotating discs of such floor grinders have grinding inserts that fit into holders located on the underside of the rotating discs. Typically, such current grinding inserts are difficult and time consuming to install. Currently, it is common practice to use wood wedges and a hammer or similar tool to pound the wood wedge in place so that it holds or secures the grinder insert prior to starting the motor that causes the disc and the associated holders and inserts to rotate. This requires that the operator of the floor grinder carry an extra tool for pounding the wood wedges in place as well as the wood wedges and replacement wood wedges for those that get damaged. Moreover, as indicated, the process of installing the wood wedges is time consuming and it takes some skill on the part of the operator. Currently, the holders for the grinder inserts are different for the discs that rotate in different directions.

The present grinder disc, insert holder and insert assembly invention solves all of these problems associated with such previous grinder disc, holder and insert assemblies and allows the grinder inserts to be rapidly installed in their holders and rapidly replaced when it is necessary. The present grinder disc, insert holder and insert assembly invention also eliminates any need to carry and use expandable wood wedges and a hammer or other tool to install the wood wedges. With the present grinder disc, insert holder and insert assembly invention, little or no skill is required to place the grinder inserts in their holders and to remove the grinder inserts from their holders. The same grinder holders and grinder inserts can also be used with discs that rotate in both directions.

SUMMARY OF THE INVENTION

This invention relates to floor grinders that have grinder discs and the like and more particularly to a grinder disc, insert holder and insert assembly for a floor grinder.

Accordingly, it is an object of the invention to provide a grinder disc, insert holder and insert assembly with improvements that provide increased performance.

It is an object of the invention to provide a grinder disc, insert holder and insert assembly that eliminates the need for extra parts that are necessary with the present grinder disc, insert holder and insert assemblies.

It is an object of the invention to provide a grinder disc, insert holder and insert assembly that requires no hand tools that are necessary with the present grinder disc, insert holder and insert assemblies.

It is an object of the invention to provide a grinder disc, insert holder and insert assembly that has a faster set up time than the present grinder disc, insert holder and insert assemblies.

It is an object of the present invention to provide a grinder disc, insert holder and insert assembly that permits the insert to be changed faster than with the present grinder disc, insert holder and insert assemblies.

It is an object of the present invention to provide a grinder disc, insert holder and insert assembly that eliminates the need for expendable supplies that are needed with present grinder disc, insert holder and insert assemblies.

It is an object of the present invention to provide a grinder disc, insert holder and insert assembly that eliminates the need for wood wedges that are needed with present grinder disc, insert holder and insert assemblies.

It is an object of the present invention to provide a grinder disc, insert holder and insert assembly that makes us of naturally occurring forces associated with a rotating disc to retain inserts in insert holders when the disc is rotating.

It is an object of the present invention to provide a grinder disc, insert holder and insert assembly that makes us of centrifugal force associated with a rotating disc to retain inserts in insert holders when the disc is rotating.

It is an object of the present invention to provide a grinder disc, insert holder and insert assembly that can use a reversible insert.

It is an object of the invention to provide a grinder disc, insert holder and insert assembly that is easier to use than past grinder disc, insert holder and insert assemblies.

It is an object of the invention to provide a grinder disc, insert holder and insert assembly with a removable insert with working surface portion in which a removable insert portion is easy to replace which was not the situation with previous grinder disc, insert holder and insert assemblies.

It is an object of the invention to provide a grinder disc, insert holder and insert assembly that costs less to operate than previous grinder disc, insert holder and insert assemblies It is an object of the invention to provide a grinder disc, insert holder and insert assembly which is easy to manufacture.

It is an object of the invention to provide a grinder disc, insert holder and insert assembly which is rugged and reliable.

It is an object of the invention to provide a grinder disc, insert holder and insert assembly which is easy to repair.

These and other objects of the invention will become apparent from the following description of the grinder disc, insert holder and insert assembly invention that includes a grinder insert holder having a generally rectangular shaped holder case with a hollow interior an open end portion and a closed end portion with an end wall, resilient means comprising a resilient generally rectangular pad sized and shaped to be located in the hollow interior of the case adjacent to the inside surface of the end wall. The grinder disc, insert holder and insert assembly also includes a grinder insert for performing work such as grinding, cutting or abrading on a surface such as concrete that is being worked on. The grinder insert has a generally rectangular shaped base that is sized and shaped to permit it to slide into the holder case of the grinder insert holder and an attached generally rectangular shaped mounting plate member having work performing members for performing work such as grinding, cutting or abrading on a surface such as concrete that is being worked on. The grinder insert holder holder has a substantially flat back portion that is attached to a substantially flat rotatable disc. A plurality of grinder insert holders are attached in a symmetric pattern to the outer edge portion of the disc with the open end portions facing in the direction of rotation of the disc and with the closed end portions with the end walls of the grinder insert holders facing outward and away from the direction of rotation of the disc member when the disc member is in operation. In addition, the disc has a center of rotation and the open end portions of the grinder insert holders are located on the disc closer to the center of rotation than the closed end portions of the grinder insert holders. A generally elongated thin retention member is provided on the disc member for each grinder insert holder and the retention member is adapted to retain the grinding insert in the associated grinder insert holder and to also permit the insert to be inserted into and removed from the holder. Each retention member has a raised retention portion that is adapted to be manually depressed to permit the grinder insert to slide over the retention portion and into or out of the holder to allow the grinder inserts to be inserted into and removed from the grinder insert holder so that the grinder inserts can be changed.

BRIEF DESCRIPTION OF THE DRAWINGS

The invention will be hereinafter more completely described with reference to the accompanying drawings in which.

DETAILED DESCRIPTION OF THE PREFERRED EMBODIMENTS

Figure 1:
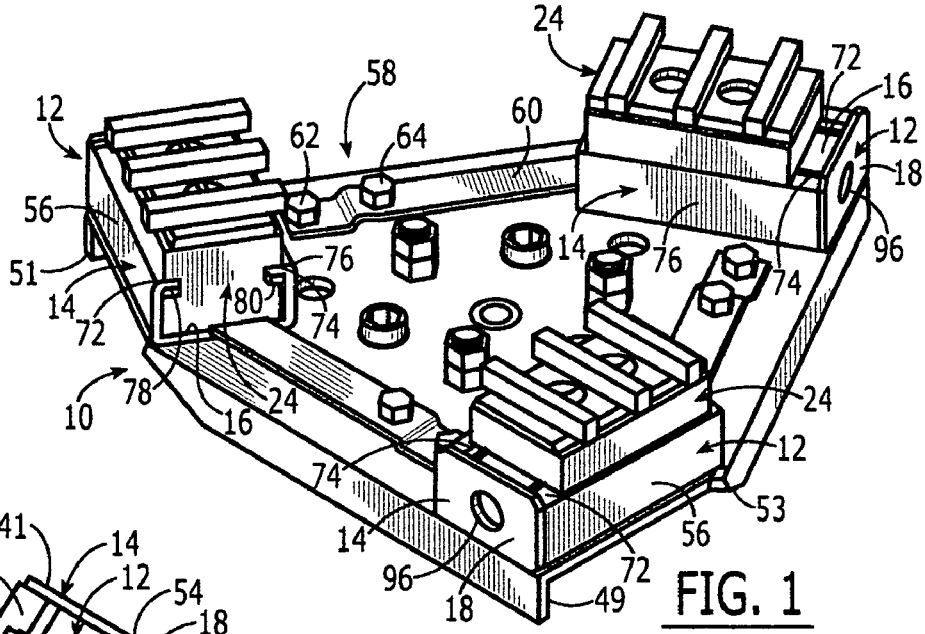
FIG. 1 is a perspective view of the assembled grinder disc, insert holder and insert assembly invention.

As used herein the words "work performing member" means a member having a surface that performs such operations as grinding, cutting, abrading, polishing or the like upon the surface such as a concrete floor or some other surface that is to be or is being worked upon. Such a work performing surface would include, but not be limited to, a diamond impregnated surface.

Referring first to FIGS. 1 through 4, the grinder disc, insert holder and insert assembly invention is illustrated and is designated generally by the number 10. The grinder disc, insert holder and insert assembly 10 includes a plurality of grinder insert holders 12 having a generally rectangular shaped holder case 14 with a hollow interior 16 and an end wall 18. Each grinder insert holder 12 also includes resilient means comprising a resilient generally rectangular rubber pad 20 that is sized and shaped to be located in the hollow interior 16 of the case 14 adjacent to the inside surface 22 of the end wall 18. The grinder disc, insert holder and insert assembly 10 also includes a plurality of grinder inserts 24 for performing work such as grinding, cutting or abrading on a surface such as concrete that is being worked on. The grinder insert 24 has a generally rectangular shaped base 26 that is sized and shaped to permit it to slide into and out of the grinder insert holder 12 and an attached generally rectangular shaped mounting plate member 28 having a series of substantially identical elongated rectangular shaped cross section shaped work performing members 30 for performing work such as grinding, cutting or abrading on a surface such as concrete that is being worked on. These work performing members 30 themselves are known in the art. The grinder insert holder 12 has a substantially flat bottom portion 32 that is attached, by welding or the like, to a substantially flat lower surface 34 of a disc member 36 that also forms part of grinder disc, insert holder and insert assembly invention 10. A plurality of grinder inset holders 12 are attached in a symmetric pattern to the outer edge portion 38 of the disc 36 at three equally spaced apart locations.

Figure 2:
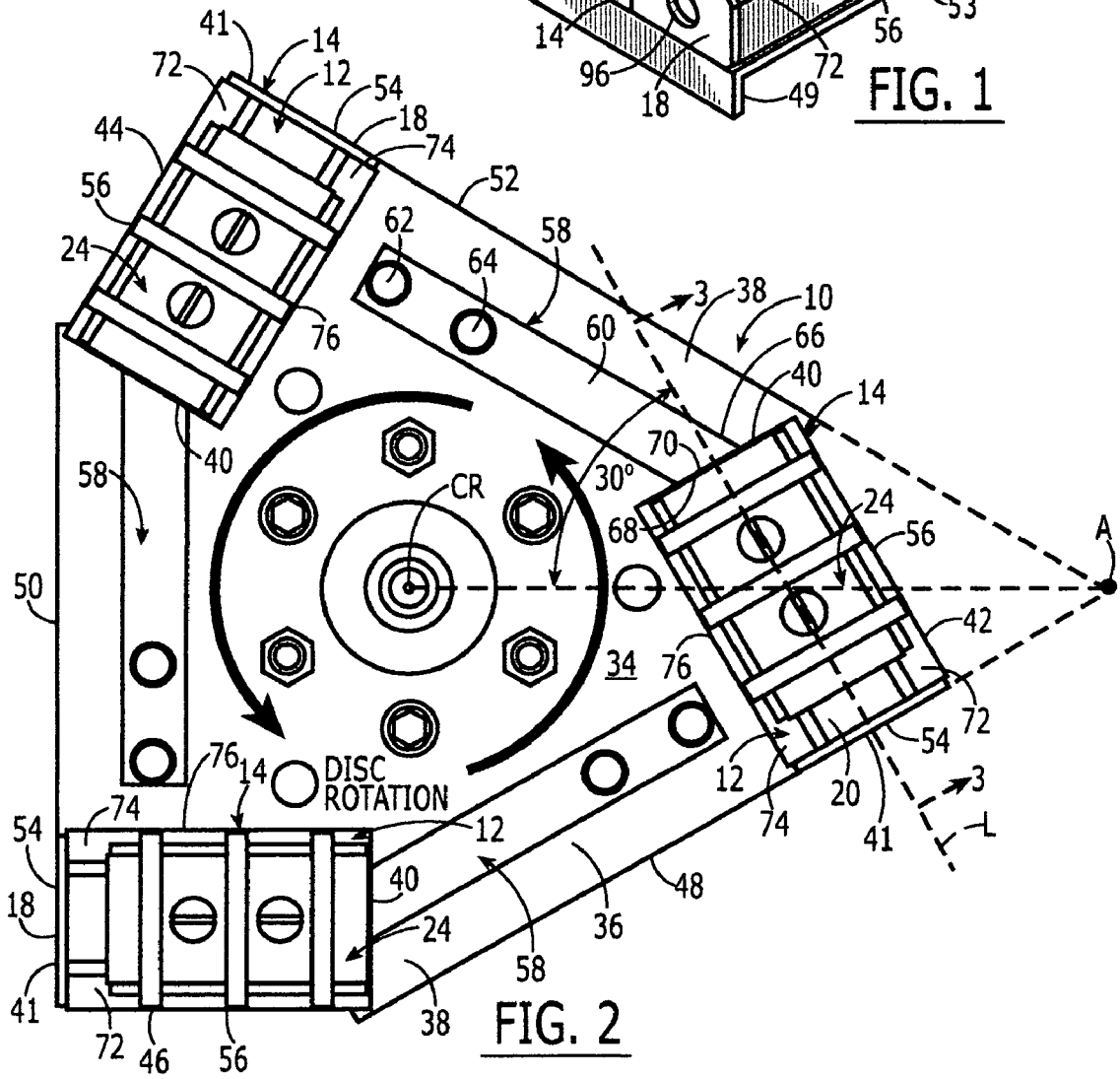
FIG. 2 is an enlarged top plan view of the grinder disc, insert holder and insert assembly invention set forth in FIG. 1.

As illustrated in FIGS. 1 and 2, it is important to note that the insert holders 12 are located about the outer portion 38 of the disc 36 in a particular orientation. In this connection, the open end portions 40 must be located closer to the center of rotation CR of the disc 36 than the closed end portions 41 with the end walls 18 of the cases 14. This is important since when the disc 36 is rotating, the grinder insert 24 that is located in the grinder insert holder 12 is retained in the holder 12 by the centrifugal force caused by the rotation of the disc 36 so that the grinder insert 24 is forced against the rubber pad 20 and toward the end wall 18 of the case 14 due to the location of the closed end portion 41 and the open end portion 40. In addition, the open end portions 40 of the cases 14 of the insert holders 12 face in the direction of the rotation of the disc 36 which is indicated as being counter clockwise in FIG. 2. This is important since if the open end portion 40 were were located in the direction away from the rotation of the disc 36, the inertia of the grinder insert 24 when the disc 36 starts to rotate would tend to pull the grinder insert out of the case 14.

The disc 36 itself as illustrated in FIG. 2, is shaped substantially like an equilateral triangle with the projecting angular ends cut off to form the three equally spaced apart straight edge portions 42, 44, and 46. These edge portions 42, 44, and 46 are located so that they form substantially ninety degree angles with the respective adjacent edge portions 48, 50, and 52 located in a direction counter to the direction of rotation of the disc 36. As best illustrated in FIG. 2, the grinder insert holders 12 are located at the edge portions 42, 44, and 46 of the disc 36 so that the outer surface 54 of the end wall 18 of the case 14 is located substantially adjacent to the edge portion 48, 50 or 52 and the adjacent outer side 56 of the case 14 is located substantially adjacent to the edge portion 42, 44, or 46 with the open end portions 40 located closer to the center of rotation CR of the disc 36 than the closed end portions 41. As previously indicated, this is important for the proper mounting of the grinder inserts 24 in the grinder insert holders 12 so that centrifugal force maintains the grinder inserts 24 in the grinder insert holders 12 when the disc 36 is rotating in use.

The orientation of the grinder inserts 24 in the grinder insert holders 12 on the disc 36 is also important for properly presenting the work performing members 30 of the grinder insert 24 to the surface that is being worked upon when the disc 36 is rotating in use. As indicated in FIG. 2, the long axis of the grinder insert 24 and the long axis of the grinder insert holder 12 that are both represented by the letter L make an angle of substantially 30 degrees with a line extending through the center of rotation CR of the disc 36 and the imaginary apex A of a triangle that would be formed by the extensions of the adjacent sides 48 and 52 of the disc 36. It has been determined that this angular relationship presents the work performing members 30 to the surface that is being worked on so that proper cutting or other finishing of the surface is obtained. It will be noted that edge portions 48, 50, and 52 of the disc 36 have respective bent ninety degree angle lip portions 49, 51 and 53 for giving the disc 36 rigidity.

Figure 3:
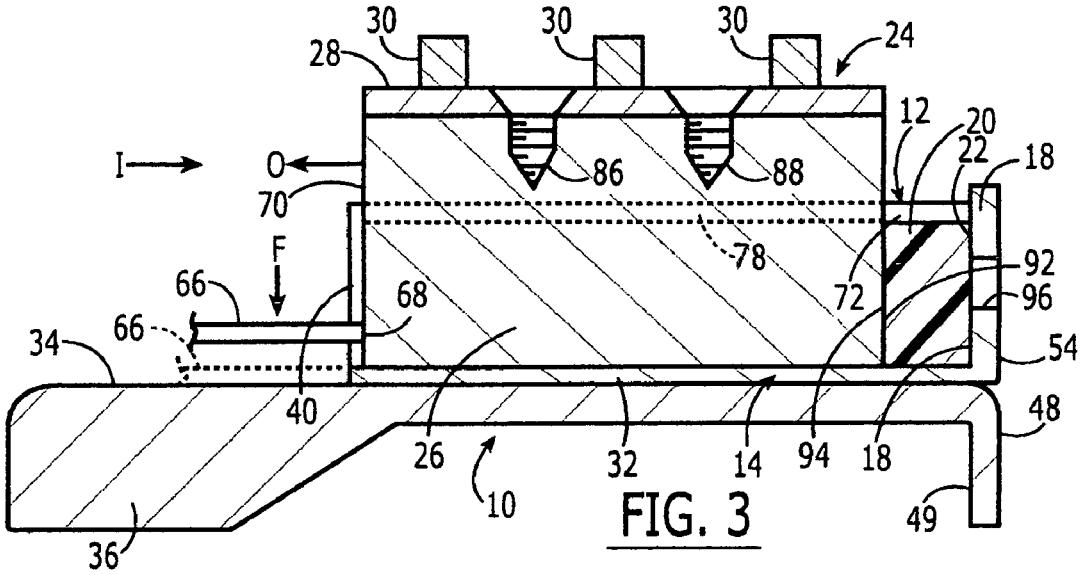
FIG. 3 is a sectional view of a portion of the assembled grinder disc, insert holder and insert assembly taken substantially on the line 3—3 in FIG. 2.

FIGS. 1, 2 and 3 also illustrate grinder insert retaining means 58 for securing or retaining the grinder inserts 24 within the grinder insert holders 12 while the disc 36 is not rotating when in use. One grinder insert retaining means 58 is provided for each insert holder 12. The grinder insert retaining means 58 comprises an elongated thin retaining member 60 that is connected to the disc 36 by two substantially identical bolts 62 and 64. The retaining member 60 has a manually operated locking portion 66 that is raised above the adjacent surface 34 of the disc 36. This manually operated locking portion 66 is free to ride up and down on the shaft of the bolt 64 so this can be depressed by the operator of the grinder disc, insert holder and insert assembly 10. This manually operated locking portion 66 has an outer end portion 68 that is shaped, sized, and located so that it contacts the outer end portion 70 of the base 26 of the grinder insert 24 when it is fully seated in the grinder insert holder 12.

Figure 4:
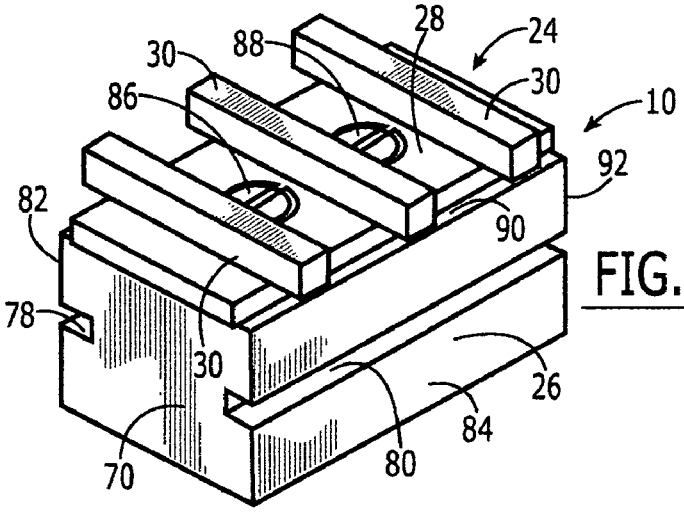
FIG. 4 is a perspective view of an insert illustrated in FIGS. 1 through 3.

FIGS. 3 and 4 indicate in greater detail the arrangement of the grinder insert holder 12 and the grinder insert 24. As illustrated in FIGS. 3 and 4 and in FIGS. 1 and 2, the base 14 of each grinder insert holder 12 has inward projecting lip portions 72 and 74 that project towards each other from the respective sides 56 and 76 of the case 14. The projecting lip portions 72 and 74 are sized, shaped and located to be received by the substantially identical respective elongated slots 78 and 80 that are located in the respective side walls 82 and 84 of the base 26 of the grinder insert 24. As indicated, two substantially identical screws 86 and 88 secure the mounting plate member 28 to the adjacent surface 90 of the base 26. The projecting lip portions 72 and 74 and the associated slots 78 and 80 permit the grinder insert 24 with its base 26 and connected mounting plate member 28 and work performing members 30 to readily slide into and out of the case 14 of the grinder insert holder 12. It will be noted in FIG. 3, that when the grinder insert 24 is fully inserted into the grinder insert holder 12, a portion of the inner end 92 of the base 26 is located adjacent to the outer surface 94 of the resilient pad 20 so that this pad 20 cushions the grinder insert 24 when it is in use.

FIG. 3 also illustrates in greater detail how the manually operated locking portion 66 of the retaining member 60 is used to retain the grinder insert 24 in the grinder insert holder 12 and yet permit the removal of the grinder insert 24 from the grinder insert holder 12. In this connection, as illustrated, the locking portion 66 of the retaining member 60 that is shown in solid lines is located adjacent to the outer end portion 70 of the base 26 and blocks the removal of the base 26 from the case 14. However, when the operator manually pushes downward on the manually operated locking portion 66 of the retaining member 60 this results in a force represented by the letter F, that pushes the locking portion 66 to the position illustrated in dashed lines that is adjacent to the surface 34 of the disc 36. Since the thickness of the locking portion 66 is less than or equal to the thickness of the portion of the case 14 that is welded to the surface 34 of the disc 36, the locking portion 66 no longer blocks the outer end 70 of the base 26 and the base 26 is free to be moved in the direction of the letter O out of the case 14. The base 26 can then be inserted into the case 14 by placing the base 26 on the locking portion 66 and again exerting the force F while pushing the base 26 in the direction indicated by the letter I. It should be noted that the end wall 18 has a circular hole 96 in it that is for use in removing the resilient rubber pad 20 from the case 14 when it needs to be replaced. This hole 96 allows an elongated object (not shown) to be placed against the pad 20 so that the pad 20 can be driven outward from the case 14.

As previously indicated, when the disc 36 is in use and is rotating, the grinder insert 24 that is located in the grinder insert holder 12 is retained in the grinder insert holder 12 by centrifugal force caused by the rotation of the disc 36 so that the grinder insert 24 is forced against the rubber pad 20 and toward the end wall 18 of the case 14. Consequently, there are virtually no forces exerted upon the locking portion 66 of the retaining member 60 when the disc 36 is in use and is rotating since centrifugal force pulls the base 26 toward the rubber pad 20 and away from the locking portion 66 of the retaining member 60. However, the retaining member 60 with the locking portion 66 is needed to keep the base 26 of the grinder insert 24 within the case 14 of the insert holder 12 when the grinder disc, insert holder and insert assembly 10 is not in use. Otherwise the base 26 of the grinder insert 24 could come out of the case 14 of the grinder insert holder 12 while the grinder disc, insert holder and insert assembly 10 is being transported or moved or is being handled which at best would be inconvenient and could result in loss of the grinder insert 24.

Due to the construction of the case 14 of the insert holder 12 and the construction of the base 26 of the grinder insert 24, the grinder insert 24 is securely connected to the disc 36 when the grinder disc, insert holder and insert assembly 10 is in use. In this connection, the case 14 is rigidly connected to the surface 34 of the disc 36 by welding. The projecting lip portions 72 and 74 of the respective sides 56 and 78 of the case 14 slide into the respective slots 78 and 80 located in the respective side walls 82 and 84 of the base 26 of the grinder insert 24 and this prevents the base 26 from being pulled out of the case 14 in a direction perpendicular to the surface 34 of the disc 36. Also, when the disc 36 is rotating in use, as previously indicated, the base 26 of the grinder insert 24 is forced against the pad 20 that is in turn retained within the case 14 by the end wall 18 of the case 14. Also, as previously indicated, the orientation of the case 14 with respect to the disc 36 and the disc 36 rotation when the disc 36 is rotating during use, prevents any substantial forces being exerted on the grinder insert 24 that would tend to pull the base 26 out of the open end portion 40 of the case 14 of the grinder insert holder 12. Consequently, the grinder insert 24 is securely connected to the disc 36 when the grinder disc, insert holder and insert assembly 10 is in use and the disc 36 is rotating which is very important for successful operation of the grinder disc, insert holder and insert assembly 10 and for safety reasons.

Figure 5:
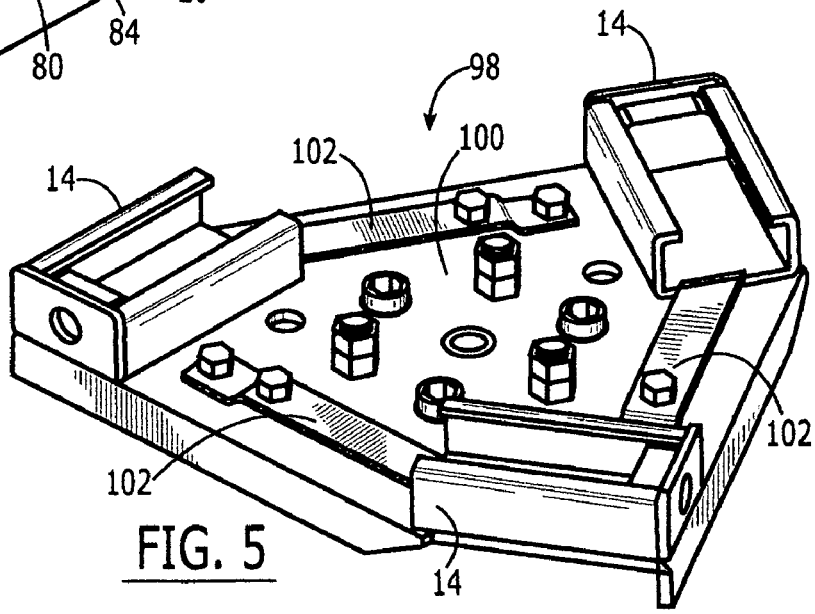
FIG. 5 is a perspective view of another assembled grinder disc, insert holder and insert assembly invention that is substantially a mirror image of the structure set forth in FIG. 1 with certain portions omitted for clarity.

FIG. 5 is a perspective view of another assembled grinder disc, insert holder and insert assembly invention that is designated generally by the number 98. This grinder disc, insert holder and insert assembly invention 98 is substantially a mirror image of the previously described grinder disc, insert holder and insert assembly 10 that is illustrated in FIGS. 1 through 4. The reason for the embodiment set forth in FIG. 5 is, as previously indicated, that certain floor grinders have more than one grinder disc and when two discs are used they need to rotate in opposite directions to reduce vibrations. As previously indicated in connection with the grinder disc, insert holder and insert assembly invention 10, the open end portions 40 of the cases 14 of the insert holders 12 must face in the direction of the rotation of the disc 36 since if they faced in the opposite direction, the grinder insert 24 would be pulled out of the grinder insert holder 12 by inertia as the disc 36 started to rotate. Consequently, the previous grinder disc, insert holder and insert assembly 10 must be replaced by the grinder disc, insert holder and insert assembly 98 with its disc 100 that rotates in the direction opposite from that indicated in FIG. 2. Basically, all the grinder disc, insert holder and insert assembly 98 requires that is different from the grinder disc, insert holder and insert assembly 10 is a new disc 100 and new retaining members 102 that are substantially mirror images of the disc 36 and the retaining members 60 of the grinder disc, insert holder and insert assembly 10. Also the grinder disc, insert holder and insert assemblies 10 and 98 function in substantially the same manner except that they rotate in opposite directions when in use. For clarity, the inserts 24 that fit into the insert holders 12 have been omitted from FIG. 5.

The grinder disc, insert holder and insert assembly invention 10 is used in the following manner. As previously indicated, the disc 36 and the connected grinder insert holders 12 are used with floor grinders (not shown) that are well known in the art for refinishing surfaces such as concrete surfaces in a conventional manner that is well known in the art and hence will not be described. The floor grinders have provisions and controls known in the art for rotating the disc 36 and if there is a two or four disc arrangement then also the disc 100 of the grinder disc, insert holder and insert assembly 98. In normal use, the resilient pads 20 would already be installed in the interior 16 of the cases 14 of the grinder insert holders 12 and if they were not then it would be installed by the operator.

In order to use the grinder disc, insert holder and insert assembly 10 and also the grinder disc, insert holder and insert assembly 98, the grinder inserts 24 are inserted into the cases 14 of the grinder insert holders 12. As indicated in FIG. 3, this is accomplished by the operator manually pushing downward on the manually operated locking portion 66 of the retaining member 60 resulting in a force represented by the letter F that pushes the locking portion 66 of the retaining member 60 to the position illustrated in dashed lines that is adjacent to the surface 34 of the disc 36 where the locking portion 66 no longer blocks the outer end portion 70 of the base 26. The operator then pushes the base 26 into the case 14 in the direction indicated by the letter I while exerting the force F on the locking portion 66 of the retaining member 60 through the base 26. The force F is then removed and the locking portion 66 due to its spring action will return to its original position to block the outer end 70 of the base 26.

When all of the grinder inserts 24 are inserted into the grinder insert holders 12, the the grinder disc, insert holder and insert assembly 10 and also the grinder disc, insert holder and insert assembly 98 and the associated case 12 are then ready to be used and they are placed in use in a normal manner that is well known to those skilled in the art. With use, the work performing members 30 can become worn in an uneven manner. When this occurs, the user or operator removes the grinder insert 24 from the case 14 of the grinder insert holder 12. In order to remove the grinder insert 24 from the case 14 of the grinder insert holder 12, the operator manually pushes downward on the manually operated locking portion 66 of the retaining member 60 and this results in a force represented by the letter F, that pushes the locking portion 66 to the position illustrated in dashed lines that is adjacent to the surface 34 of the disc 36 where the locking portion 66 no longer blocks the outer end portion 70 of the base 26 and the base 26 is free to be moved in the direction of the letter O out of the case 14. The operator then moves the base 26 in the direction of the letter O and out of the case 14. Then, the grinder insert 24 that was removed from the case 14 is rotated 180 degrees so that the location of the work performing members 30 is reversed and then the grinder insert 24 is reinserted into the interior 16 of the case 14 in the previously described manner. This extends the useful life of the work performing members 30. With continued use, a point will be reached where the useful life of the work performing members 30 is ended. At that point the grinder inserts 24 are removed from the cases 14 of the grinder insert holders 12 and replaced by new grinder inserts 24 or grinder inserts that have new work performing members 30. This is accomplished using the same previously described procedures for removing the grinder insert 24 from the case 14 of the grinder insert holder 12, rotating the grinder insert and replacing the grinder insert 24 in the grinder insert holder 12.

As previously indicated, should it be necessary to remove the resilient pad 20 from the case 14 of the grinder insert holder 12, the hole 96 in the end wall 18 of the case 14 can be used to allow an elongated object (not shown) to be placed against the pad 20 so that the pad 20 can be driven outward from the case 14.

The grinder disc, insert holder and insert assembly 10 and also the grinder disc, insert holder and insert assembly 98 are made for standard materials known in the art using suitable casting, cutting and machining techniques known in the art. The base 24 is made from a suitable grade of aluminum by known techniques and the various surfaces are suitably machined where necessary. In a similar manner, the resilient pad 20 is formed from recycled rubber using rubber forming techniques known in the art. The discs 36 and 100 and the retaining members 60 and 102 and the mounting plate 28 are made from a suitable grade of hot rolled steel using suitable machining and heat treating techniques and they are assembled using conventional welding and other techniques known in the art. As previously indicated, the work performing members 30 are conventional and are secured to the mounting plate member 28 by known silver soldering techniques.

Although the invention has been described in considerable detail with reference to certain preferred embodiments, it will be understood that variations or modifications may be made within the spirit and scope of the invention as defined in the appended claims.

What is claimed is:

1. A grinder disc, grinder insert holder and grinder insert assembly including a rotatable disc member having a center of rotation, a plurality of grinder insert holders located on the disc member with each grinder insert holder having an open end portion and a closed end portion and a plurality of grinder inserts with the grinder insert holders and the grinder inserts being sized and shaped to permit the grinder inserts to be removably located within the the grinder insert holders and centrifugal force means for using centrifugal force for securing the grinder inserts within the grinder insert holders, the centrifugal force means comprising the grinder insert holders being oriented to have the closed end portions of the the grinder insert holders located further away from the center of rotation of the disc member than the open end portions.

2. The grinder disc, grinder insert holder and grinder insert assembly of claim 1 further comprising means for preventing inertia from pulling the grinder inserts out of the grinder insert holders.

3. The grinder disc, grinder insert holder and grinder insert assembly of claim 1 further comprising means for securing the grinder inserts within the grinder insert holders when the disc is not rotating.

4. The grinder disc, grinder insert holder and grinder insert assembly of claim 3 wherein the means for securing the grinder inserts within the grinder insert holders when the disc is not rotating comprises means for contacting the grinder insert when the grinder insert is located within the grinder insert holder and preventing removal of the grinder insert from the grinder insert holder.

5. The grinder disc, grinder insert holder and grinder insert assembly of claim 4 wherein the the grinder insert and the grinder insert holder have means for permitting the grinder insert to slide within the grinder insert holder.

6. The grinder disc, grinder insert holder and grinder insert assembly of claim 5 wherein the means for permitting the grinder insert to slide within the grinder insert holder comprises projections located on the grinder insert holder and slots located on the grinder insert sized, shaped and located to receive the projections located on the grinder insert holder.

7. The grinder disc, grinder insert holder and grinder insert assembly of claim 1 further comprising resilient cushioning means for cushioning the grinder inserts.

8. The grinder disc, grinder insert holder and grinder insert assembly of claim 7 wherein the resilient cushioning means comprises resilient pads located within the grinder insert holders.

* * * * *